US005742872A

United States Patent [19]

Copperwheat et al.

[11] Patent Number: 5,742,872

[45] Date of Patent: Apr. 21, 1998

[54] HIGH VOLTAGE COMMUTATING CONNECTOR FOR A ROTATING SEGMENTED ELECTRODE DONOR ROLL

[75] Inventors: Jon F. Copperwheat, Fairport; Jonathan T. Abbe, Webster; Sam E. Stewart, Rochester, all of N.Y.

[73] Assignee: Xerox Corporation, Stamford, Conn.

[21] Appl. No.: 719,270

[22] Filed: Sep. 24, 1996

[51] Int. Cl.[6] ..... G03G 21/20

[52] U.S. Cl. ..... 399/92; 399/285

[58] Field of Search ..... 399/266, 270, 399/285, 92, 98, 99; 310/233

[56] References Cited

U.S. PATENT DOCUMENTS

| | | | |
|---|---|---|---|
| 5,289,240 | 2/1994 | Wayman | 399/266 |
| 5,339,142 | 8/1994 | Hays | 399/253 |
| 5,360,940 | 11/1994 | Hays | 399/266 |
| 5,515,142 | 5/1996 | Rommelmann . | |
| 5,517,287 | 5/1996 | Rodriguez et al. | 399/285 |
| 5,539,505 | 7/1996 | Parker | 399/285 |
| 5,570,169 | 10/1996 | Hart | 399/285 |
| 5,594,534 | 1/1997 | Genovese | 399/285 |
| 5,600,418 | 2/1997 | Hart et al. | 399/285 |

*Primary Examiner*—Robert Beatty

*Attorney, Agent, or Firm*—H. Fleischer; J. E. Beck; R. Zibelli

[57] ABSTRACT

A commutating connector which electrically connects conductive paths of a rotating electroded donor roll to a voltage source. The connector includes a housing made of an electrically insulating material. The housing defines a chamber to receive the donor roll. An electrically conductive brush is disposed in the chamber. The brush is mounted in pressing engagement against the conductive paths on the electroded donor roll to electrically connect the voltage source to the conductive paths on the electroded donor roll. The chamber is divided by a partition into a commutating and a non-commutating area. The housing has ports for receiving air to prevent particulate matter from accumulating between the brush and donor roll.

18 Claims, 3 Drawing Sheets

HIGH VOLTAGE COMMUTATING CONNECTOR FOR A ROTATING SEGMENTED ELECTRODE DONOR ROLL

The present invention relates generally to an electrophotographic printing machine, and more particularly relates to a commutating connector which electrically connects conductive paths of a rotating donor roll to a voltage source.

Generally, the process of electrophotographic printing includes the step of charging a photoconductive member to a substantially uniform potential to sensitize the surface thereof. The charged portion of the photoconductive surface is exposed to a light image of an original document being reproduced. This records an electrostatic image on the photoconductive member corresponding to the original document. The recorded latent image is then developed by bringing a developer material into contact therewith. This forms a toner powder image on the photoconductive member which is subsequently transferred to a copy sheet. Finally, the powder image is heated to permanently affix it to the sheet in image configuration.

There are various known forms of development systems for bringing toner particles to a latent image on a photoconductive surface. One form uses a magnetic brush roll and a donor roll, both of which are rotating. The magnetic brush roll picks up developer material from a reservoir via magnetic attraction. It transfers toner to the donor roll, at a loading zone located between the two rolls. The donor roll carries the toner into proximity with the latent image, at a development zone located between the donor roll and the photoconductive surface. The donor roll has a plurality of segmented electrodes which are formed integral thereto. The electrodes are electrically biased to detach toner from the donor roll and form a toner cloud in the development zone, with the toner developing the latent image. Electrode biasing is accomplished by conductive, commutating brushes placed in stationary positions to contact the electrodes on the periphery of the donor roll. The brushes are typically conductive fiber brushes made from pultruded fibers or solid graphite. The brushes are connected to an electrically biasing source. Both the electrode located in the development zone and the electrode in the loading zone are electrically biased. As the donor roll rotates, the electrode in the development zone needs to contact the development zone brush. Likewise, the electrode in the in the loading zone needs to contact the loading zone brush. Since the nips at the development and loading zones are very small, it is impractical to position the brushes in the nips. Accordingly, the brushes are extended beyond their respective nips.

The use of commutating brushes in contact with the donor rolls has many problems. Firstly, the electrode potential difference required to bias the donor roll is in excess of 1,000 volts. At this voltage, the make and break contact action of the brushes (with their respective electrodes) causes unwanted EMI (Electro-Magnetic Interference) that adversely affects machine operation and image quality. Secondly, a rubbing-type contact of the brushes causes commutation electrode wear. This type of wear reduces the MTBF (Mean Time Between Failures) of the donor roll. Thirdly, the arcing and rubbing between the brushes and electrodes generates enough heat to melt toner particles located near the commutating areas. The melted toner particles coalesce and tend to create toner lumps that negatively affect image quality and machine reliability. Fourthly, when carbon fiber brushes are used, the fibers continually wear until they are separated from the brush and contaminate the intricate workings of the machine. Fifthly, airborne contaminates (i.e., paper and clothing fibers) become trapped between the brush and the electrodes to cause a premature failure.

Clearly, it would be highly desirable to employ a connector that reduces or eliminates the commutating problems heretofore described. The high voltage commutating connector of the present invention is designed to be size compatible with a dual donor roll developer system. This type of connector provides a method of protecting the commutating area. It prevents toner from migrating into the commutating area, thus reducing previously experienced failures due to donor roll material degradation. The high voltage commutating connector may be employed in at least two recognized methods of commutation comprising a continuos electrical bias application, and the application of an electrical bias when only specific electrodes are in the development and loading zones. The latter method reduces EMI.

The following disclosure related to electrodroded rolls may be relevant to various aspects of the present invention:

U.S. Pat. No. 5,515,142

Patentee: Rommelmann

Issue Date: May 7, 1996

U.S. Pat. No. 5,515,142 discloses a donor roll for transporting marking particles to an electrostatic latent image recorded on a surface. The donor roll includes a body rotatable about a longitudinal axis and an electrode member. The member includes a plurality of electrical conductors being spaced on the body with adjacent conductors being spaced from one another having at least a portion thereof extending in a direction transverse to the longitudinal axis of the body.

In accordance with one aspect the invention, there is provided a commutating connector which electrically connects conductive paths of a rotating electroded donor roll to a voltage source. The connector includes a housing made of an electrically insulating material. The housing defines a chamber to receive the donor roll. An electrically conductive brush is disposed in the chamber. The brush is mounted in pressing engagement against the conductive paths on the electroded donor roll to electrically connect the voltage source to the conductive paths on the electroded donor roll.

In accordance with another aspect of the invention, there is provided a developer unit of the type having a commutating connector which electrically connects conductive paths of a rotating electroded donor roll to a voltage source. The improvement includes a housing made of an electrically insulating material. The housing defines a chamber to receive the donor roll. An electrically conductive brush is disposed in the chamber. The brush is mounted in pressing engagement against the conductive paths on the electroded donor roll to electrically connect the voltage source to the conductive paths on the electroded donor roll.

In accordance with yet another aspect of the invention, there is provided an electrophotographic printing machine of the type having a commutating connector which electrically connects conductive paths of a rotating electroded donor roll to a voltage source. The improvement includes a housing made of an electrically insulating material. The housing defines a chamber to receive the donor roll. An electrically conductive brush is disposed in the chamber. The brush is mounted in pressing engagement against the conductive paths on the electroded donor roll to electrically connect the voltage source to the conductive paths on the electroded donor roll.

Other aspects of the present invention will become apparent as the following description proceeds and upon reference to the drawings, in which.

Figure 1:
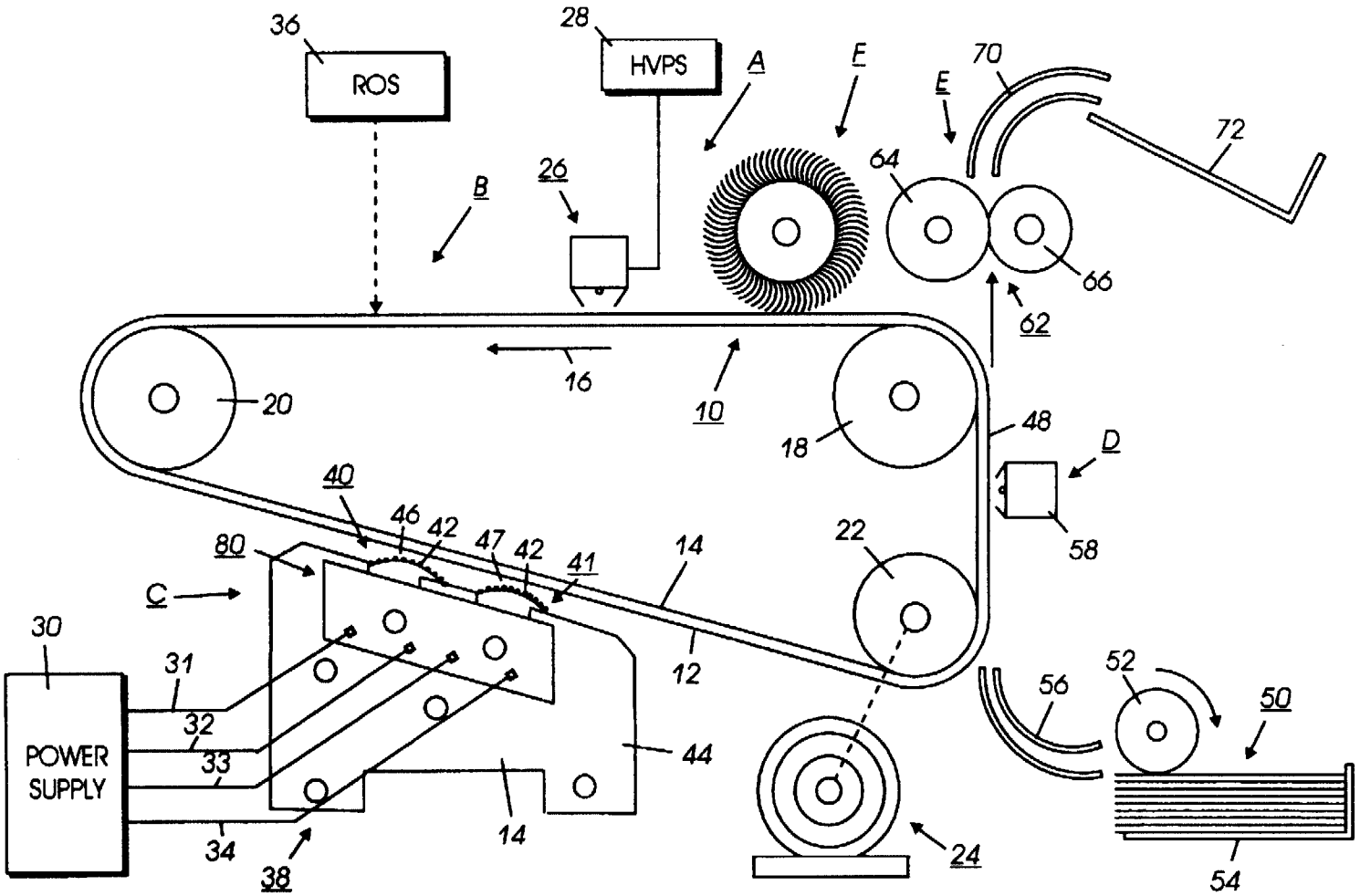
FIG. 1 is a schematic, elevational view showing an electrophotographic printing machine incorporating the features of the present invention therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

In the drawings like reference numerals have been used throughout to designate identical elements.

Referring initially to FIG. 1, there is shown an illustrative electrophotographic printing machine incorporating the high voltage commutating connector of the present invention therein. The printing machine incorporates a photoreceptor 10 in the form of a belt having a photoconductive surface layer 12 on an electroconductive substrate 14. Preferably the surface 12 is made from a selenium alloy. The substrate 14 is preferably made from an aluminum alloy which is electrically grounded. The belt is driven by motor 24 along a path defined by rollers 18, 20 and 22, the direction of movement being counter-clockwise, as shown by arrow 16. Initially, a portion of the belt 10 passes through a charge station A where corona generator 26 charges surface 12 to a relatively high, substantially uniform, potential. A high voltage power supply 28 is coupled to device 26.

Next, the charged portion of photoconductive surface 12 is advanced through exposure station B. At exposure station B, ROS (Raster Output Scanner) 36 and a RIS (Raster Input Scanner) not shown are used to expose the charged portions of photoconductive surface 12 for recording an electrostatic latent image thereon. The RIS, contains document illumination lamps, optics, a mechanical scanning mechanism and photosensing elements such as charge-coupled device (CCD) arrays. The RIS captures the entire image from the original document and converts it to a series of raster scan lines. These raster scan lines are transmitted from the RIS to the ROS 36. ROS 36 illuminates the charged portion of photoconductive surface 12 with a series of horizontal lines, each line having a specific number of pixels per inch. These lines illuminate the charged portion of the photoconductive surface 12 to selectively discharge the charge thereon. An exemplary ROS 36 has lasers with rotating polygon mirror blocks, solid state modulator bars and mirrors. Still another type of exposure system would merely utilize a ROS 36 with the ROS 36 being controlled by the output from an electronic subsystem (ESS) that prepares and manages the image data flow between a computer and the ROS 36. The ESS (not shown) is the control electronics for the ROS 36 and may be a serf-contained, dedicated minicomputer.

One skilled in the art will appreciate that a light lens system may be used instead of the RIS/ROS system heretofore described. An original document may be positioned face down upon a transparent platen. Lamps would flash light rays onto the original document. The light rays reflected from the original document are transmitted through a lens forming a light image thereof. The lens focuses the light image onto the charged portion of photoconductive surface to selectively dissipate the charge thereon. This records an electrostatic latent image on the photoconductive surface which corresponds to the informational areas contained within the original document disposed upon the transparent platen.

After the electrostatic latent image has been recorded on the photoconductive surface 12 of belt 10, belt 10 advances the latent image to development station C. At development station C, a development system 38, develops the latent image recorded on the photoconductive surface. Preferably, development system 38 includes donor rolls 40 and 41, each having electrically biased electrode wires 42 to form toner powder clouds in development zones 46 and 47 respectively. The use of more than one development zone ensures satisfactory development of the latent image at increased process speeds. The latent image attracts toner particles from the toner powder cloud forming a toner powder image thereon. If required, development zone 46 and 47 may have different characteristics through the application of a different electrical bias to each of the donor rolls. The characteristics of development zone 46 may be selected to achieve optimum line development and the transfer characteristics of development zone 47 may be selected to achieve optimum development of solid areas. The donor rolls 40 and 41 are mounted, at least partially, in the chamber of developer housing 44. The chamber in developer housing 44 stores a supply of developer material therein. The developer material is a two component developer material of at least magnetic carrier granules having toner particles adhering triboelectrically thereto. A transport roll (not shown) disposed interiorly of the chamber of housing 44 loads toner on to donor roll 40 and 41. The transport roll is electrically biased relative to donor rolls 40 and 41 so that the toner particles are attracted from the transport roller to the donor rolls. A high voltage commutating connector 80 connects donor rolls 40 and 41 to a power supply 30 via conductors 31, 32, 33, and 34. One skilled in the art will recognized that connector 80 may be mounted to the exterior or interior of housing 44. The high voltage commutating connector 80 will be described in greater detail hereinafter with reference to FIGS. 2–4.

Belt 10 advances the developed image to transfer station D. A copy sheet 54 is advanced by roll 52 and guides 56 into contact with the developed image on belt 10. A corona generator 58 sprays ions on the backside of the sheet 54 to attract the toner image from belt 10 to the sheet. As the belt turns around roller 18, the sheet is stripped therefrom with the toner image thereon.

Subsequently, the sheet is advanced by a conveyor (not shown) to fusing station E. Fusing station E includes a heated fuser roller 64 and a back-up roller 66. The sheet passes between fuser roller 64 and back-up roller 66 with the toner powder image contacting fuser roller 64. In this way, the toner powder image is permanently affixed to the sheet. After fusing, the sheet advances through chute 70 to catch tray 72 for subsequent removal from the printing machine, by the operator.

After the sheet is separated from belt 10, the residual toner particles adhering to the photoconductive surface 12 are removed therefrom at cleaning station F. A rotatably mounted fibrous brush 74 contacts the photoconductive surface 12 and cleans residual toner and contamination therefrom. Subsequent to cleaning, a discharge lamp (not shown) floods photoconductive surface 12 with light to dissipate any residual electrostatic charge remaining thereon prior to charging, at the next successive imaging cycle.

Figure 2:
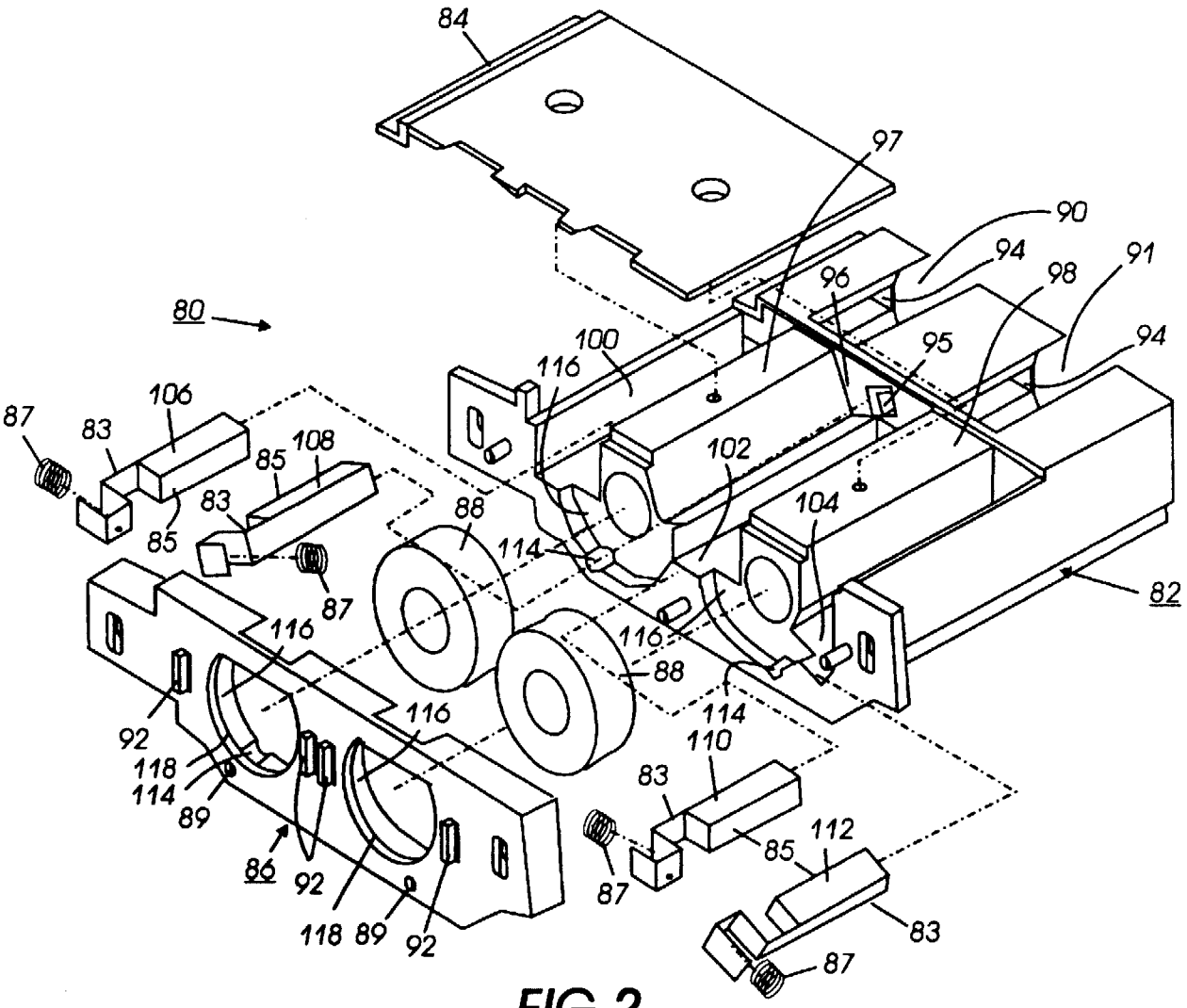
FIG. 2 is a perspective view showing the high voltage commutating connector for a rotating electroded donor roll of the FIG. 1 printing machine in greater detail.

FIG. 2 illustrates a commutating connector 80 that distributes high voltage to a pair of rotating segmented donor rolls (not shown). The body of connector 80 consists of a substantially rectangular housing 82. Housing 82 comprises an insulating material having a high electrical resistivity in the range of approximately $10^6$–$10^{15}$ ohm-meters. The housing 82 defines a chamber for each donor roll inserted into connector 80. The chamber is further divided into non-commutating areas and commutating areas. The commutating areas 90 and 91 are located in the rear of housing 80. The non-commutating areas are in front of the commutating areas. Commutating areas 90 and 91 contain a pair of opposing guides that define channels 94. Each channel 94 holds one of a plurality of brushes 106, 108, 110, and 112 so that a contact surface 85 thereon touches the respective donor roll. Brushes 106, 108, 110, and 112 are electrically conductive and typically made from fibers or solid graphite. Every brush includes an electrically conductive holder 83. A compression spring 87 extended, in a direction, perpendicular to each holder 83 engages its respective brush against electrodes on the donor roll surfaces (not shown). The non-commutating area accurately guides the donor rolls and brushes in connector 80 and includes cavities 100, 102, and 104 enclosed by a removable top cover 84. Each cavity shape locates the respective brush relative to a development or a reload zone (explained hereinafter in FIG. 4) on the corresponding donor roll. Cavity 100 locates brush 106. Cavity 102 locates brushes 108 and 110, and cavity 104 locates brush 112. Elongated, semi-cylindrical tubes 97 and 98 interposed between the cavities 100, 102, and 104 convey the shaft end of each donor roll to a source of rotational motion, such as a motor (not shown). Bearings 88 support the donor roll shafts (not shown) as they pass through "D-shaped" holes 118 in a cover 86, at the front of housing 82. Cover 86 has a plurality of double-ended terminals 92 extending therefrom. Terminals 92 interconnect brush holders 83 to the power supply 30, shown in FIG. 1. Each holder 83 has a current carrying conductor electrically bonded thereto. The conductors are discussed in greater detail at FIG. 3. Air inlet ports 89, in cover 86, cooperate with a mating trough 114 (located in bearing recesses 116 on cover 86 and tubes 97 and 98) to form a low pressure air seal. The inlet ports 89 connect to an air source (not shown) to circulate moving air through areas 90 and 91. Air is removed from areas 90 and 91 by way the troughs 114 that extend through tubes 97 and 98. The air flows through the troughs 114 and out the ports 89. Alternatively, one skilled in the art will recognize that air may be pumped into connector 80. In either condition, the moving air prevents particulate matter from building up in the gaps formed between the brushes and the donor roll surfaces. A partition 96 separates the non-commutating and commutating areas to also restrict movement of particulate matter from one chamber to the other. Square-shaped apertures 95, in partition 96, provide passageways for the brushes to pass from the second to the first chamber.

Figure 3:
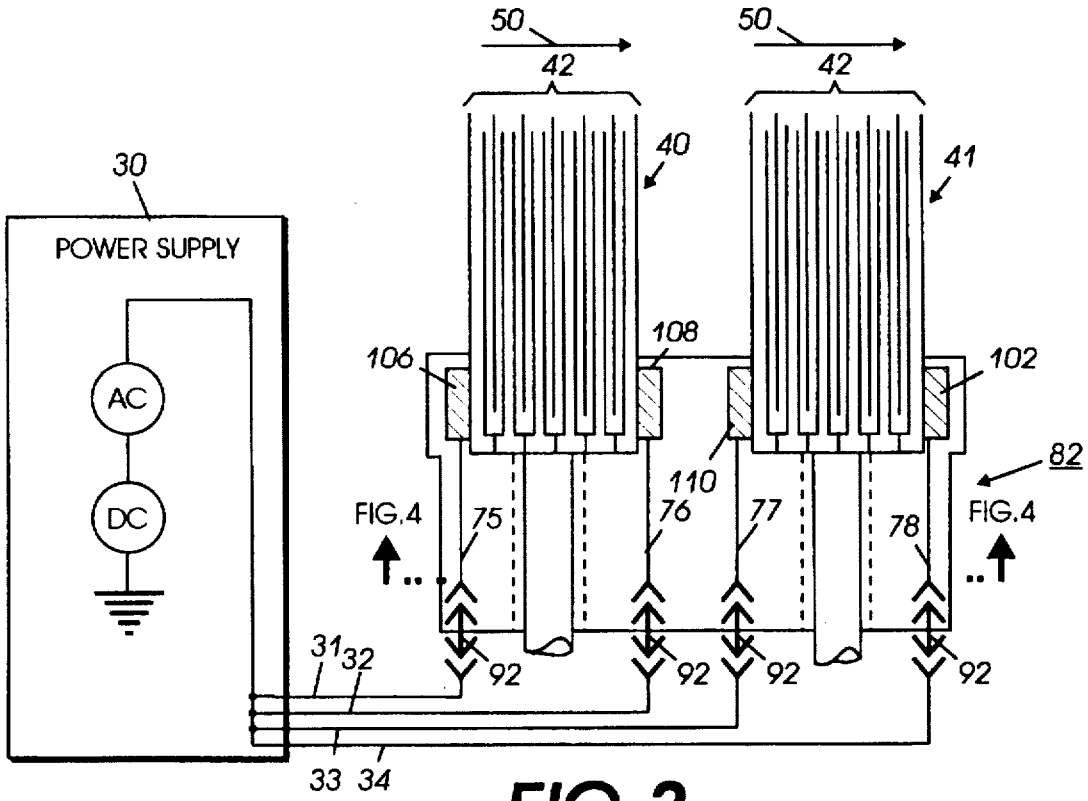
FIG. 3 is a schematic, top view of the high voltage commutating connector.

FIG. 3 shows a schematic top view of commutating connector 80 with donor rolls 40 and 41 inserted therein. Donor rolls 40 and 41 have a plurality of electrodes 42 positioned about the surface of their peripheral circumference. Spacing between electrodes 42 substantially insulate the electrodes from the donor roll bodies. Donor rolls 40 and 41 may be of the type described in U.S. Pat. No. 5,515,142 to Rommelmann hereby incorporated, in its entirety, into the instant disclosure. Brushes 106, 108, 110, and 102 connect to one end of the respective terminals 92 by way of conductors 75, 76, 77, and 78 (bonded to the respective holder 83 of FIG. 2). Each terminal 92 connects one of connectors 75, 76, 77, and 78 to power supply 30. Conductor 75 connects to power supply 30 by way of conductor 31. Similarly, conductor 76 interconnects by conductor 32, conductor 77 interconnects through conductor 33, and conductor 78 interconnects by conductor 34. Donor rolls 40 and 41 rotate in the direction of arrow 50 so that power supply 30 is in wiping contact with electrodes 42. Brushes 106 and 110 wipe electrodes 42 prior to development zones 46 and 47 of FIG. 1. Likewise, brushes 108 and 102 wipe the electrodes prior to a reload zone which is discussed hereinafter at FIG. 4.

Figure 4:
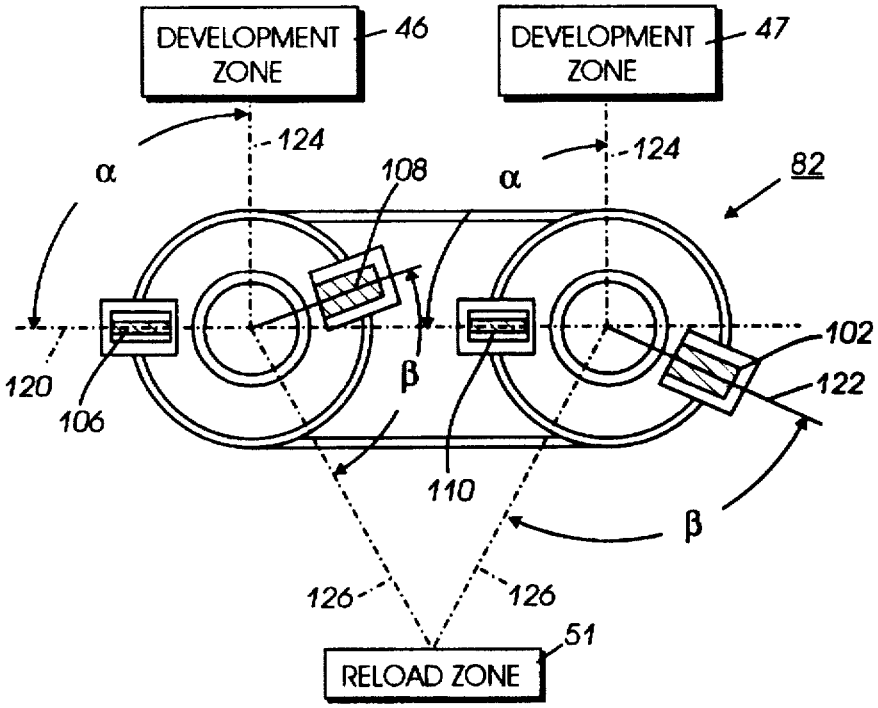
FIG. 4 is a schematic elevational view of the high voltage commutating connector illustrating brush locations.

FIG. 4 is a front view of connector 80 schematically illustrating brush location lo according to the development and reload zone. As explained previously, the use of more than one development zone guarantees satisfactory development of the latent image at increased process speeds. Brush 106 and 110 electrically bias the donor roll electrodes to detach toner therefrom and form toner powder clouds in development zone 46 and 47. A first angle $\alpha$ defines the angle between the radial position of the electrode at a wiping position 120 and the radial position of the biased electrode at a development zone position 124. To permit ample room for brush 106 and 110, the value of angle $\alpha$ is preferably about 90 degrees. However, an angle $\alpha$ of 10 degrees or more may be sufficient to accomplish the purpose of the invention.

In FIG. 4, brushes 108 and 102 electrically bias the donor roll electrodes to attract a layer of toner particles from a transport roll (not shown) to the donor rolls, at a common reload zone 51. A second angle $\beta$ defines the angle between the radial position of the electrode at a wiping position 122 and the radial position of the biased electrode at a reload zone position 126. To permit ample room for brush 108 and 102, the value of angle $\beta$ is preferably about 90 degrees. However, an angle $\beta$ of 10 degrees or more may be sufficient to accomplish the purpose of the invention.

It is, therefore, evident that there has been provided, in accordance with the present invention, a developer unit having a high voltage commutating connector for rotating donor rolls that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which may fall within the spirit and broad scope of the appended claims.

We claim:

1. A commutating connector for electrically connecting conductive paths of a rotating electroded donor roll to a voltage source, including:

an electrically insulating housing defining a chamber to receive the donor roll; and an electrically conductive brush member disposed in said chamber, said brush member being mounted in pressing engagement against the conductive paths on the electroded donor roll to electrically connect the voltage source to the conductive paths on the electroded donor roll, said housing defining ports for receiving air thereat to circulate through said brush to prevent particulate matter from accumulating in the gaps formed between said brush and the donor roll.

2. A connector according to claim 1, wherein the brush member includes a solid graphite material.

3. A commutating connector for electrically connecting conductive paths of a rotating electroded donor roll to a voltage source, including:

an electrically insulating housing defining a chamber to receive the donor roll;

an electrically conductive brush member disposed in said chamber, said brush member being mounted in pressing engagement against the conductive paths on the electroded donor roll to electrically connect the voltage source to the conductive paths on the electroded donor roller;

an electrically conductive holding member adapted to hold said brush member;

a resilient spring associated with said holding member;

a bearing member for supporting the donor roll;

a partition separating said chamber into a non-commutating area and a commutating area with a portion of said brush holder being in the non-commutating area and the commutating area; and a cover adapted to be attached to said housing, said cover having an electrical terminal extending therethrough for connecting said brush holding member to the voltage source, said cover sealing said housing, and defining a passageway for a portion of the donor roll.

4. A connector according to claim 3, wherein said non-commutating area includes:

a motor for rotating said donor roll;

a first guide having portions defining a cavity for guiding said brush member to said commutating area; and an elongated tube adjacent said first guide, for enabling the donor roll to be coupled to said motor.

5. A connector according to claim 4, wherein said commutating area includes a second guide having portions defining a channel for guiding said brush member into contact with the donor roll.

6. A connector according to claim 3, wherein said electrically conductive holding member further includes an electrical conductor having a first end bonded to said holding member and a second end connected to the electrical terminal in said cover.

7. A developer unit of the type having a commutative connector for electrically connecting conductive paths of a rotating electroded roll to a voltage source wherein the improvement includes:

an electrically insulating housing defining a chamber to receive the donor roll; and an electrically conductive brush member disposed in said chamber, said brush member being mounted in pressing engagement against the conductive paths of the electroded donor roll to electrically connect the voltage source to the conductive paths on the donor roll, said housing defining ports for receiving air to prevent particulate material from accumulating in the gaps formed between said brush and said donor roll.

8. A developer unit of the type having a commutating connector for electrically connecting conductive paths of a rotating electroded donor roll to a voltage source, wherein the improvement includes:

an electrically insulating housing defining a chamber to receive the donor roll;

an electrically conductive brush disposed in said chamber, said brush being mounted in pressing engagement against the conductive paths on the electroded donor roll to electrically connect the voltage source to the conductive paths on the electroded donor roll;

an electrically conductive holding member adapted to hold said brush member;

a resilient spring associated with said holding member;

a bearing member for supporting the donor roll;

a partition separating said chamber into a non-commutating area and a commutating area with a portion of said brush holding member being in the non-commutating area and the commutating area; and a cover adapted to be attached to said housing, said cover having an electrical terminal extending thereto for connecting said brush holding member to the voltage source, said cover sealing said housing and defining a passageway for a portion of the donor roll.

9. A developer unit according to claim 8, wherein said non-commutating area includes:

a motor for rotating said donor roll;

a first guide having portions defining a cavity for guiding said brush member to said commutating area; and an elongated tube adjacent said first guide, for enabling the donor roll to be coupled to said motor.

10. A developer unit according to claim 9, wherein said commutating area includes a second guide having portions defining a channel for guiding said brush member into contact with the donor roll.

11. A developer unit according to claim 8, wherein the brush member includes a solid graphite material.

12. A developer unit according to claim 8, wherein said electrically conductive holding member further includes an electrical conductor having a first end bonded to said holding member and a second end connected to the electrical terminal in said cover.

13. An electrophotographic printing machine of the type having a commutating connector for electrically connecting conductive paths of a rotating electroded donor roll to a voltage source, wherein the improvement includes:

an electrically insulating housing defining a chamber to receive the donor roll; and an electrically conductive brush member disposed in said chamber, said brush member being mounted in pressing engagement against the conductive paths on the electroded donor roll to electrically connect the voltage source to the conductive paths on the electroded donor roll, said housing defining air inlet ports for receiving air to circulate and prevent particulate matter from accumulating in the gaps formed between said brush and said donor roll.

14. An electrophotographic printing machine of the type having a commutating connector for electrically connecting conductive paths of a rotating electroded donor roll to a voltage source, wherein the improvement includes:

an electrically insulating housing defining a chamber to receive the donor rolls;

an electrically conductive brush member disposed in said chamber, said brush member being mounted in pressing engagement against the conductive paths on the electroded donor roll to electrically connect the voltage source to the conductive paths on the electroded donor roll;

an electrically conductive holding member adapted to hold said brush member;

a resilient spring associated with said holding member;

a bearing member for supporting the donor roll;

a partition separating said chamber into a non-commutating area and a commutating area with a portion of said brush holding member being in the non-communicating area and the commutating area; and a cover adapted to be attached to said housing, said cover having an electrical terminal extending thereto for connecting said brush holding member to the voltage source, said cover sealing said housing, and defining a passageway for a portion of the donor roll.

15. A printing machine according to claim 14, wherein said non-commutating area includes:

a motor for rotating said donor roll;

a first guide having portions defining a cavity for guiding said brush member to said commutating area; and an elongated tube adjacent said first guide, for enabling the donor roll to be coupled to said motor.

16. A printing machine according to claim 15, wherein said commutating area includes a second guide having portions defining a channel for guiding said brush member into contact with the donor roll.

17. A printing machine according to claim 14, wherein the brush member includes a solid graphite material.

18. A printing machine according to claim 14, wherein said electrically conductive holding member further includes an electrical conductor having a first end bonded to said holding member and a second end connected to the electrical terminal in said cover.

* * * * *